United States Patent [19]

Lamy et al.

[11] Patent Number: 4,556,004

[45] Date of Patent: Dec. 3, 1985

[54] FLOATING DEVICE FOR HOISTING AND TRANSPORTING LOADS

[75] Inventors: Jacques E. Lamy, Fontenay-aux-Roses; Francisco de Asis M. Serrano, Issy-les-Moulineaux, both of France

[73] Assignee: Compagnie Generale pour les Developpements Operationnels des Richesses sous-Marines "C.G. Doris", France

[21] Appl. No.: 503,158

[22] PCT Filed: Oct. 12, 1982

[86] PCT No.: PCT/FR82/00166

§ 371 Date: Jun. 1, 1983

§ 102(e) Date: Jun. 1, 1983

[87] PCT Pub. No.: WO83/01235

PCT Pub. Date: Apr. 14, 1983

[30] Foreign Application Priority Data

Oct. 12, 1981 [FR] France ..... 81 19164

[51] Int. Cl.[4] ..... B63B 25/00

[52] U.S. Cl. ..... 114/61; 114/258; 405/209; 414/137

[58] Field of Search ..... 114/61, 265, 258–260, 114/44, 45; 405/203, 209; 414/137, 138, 458, 459, 753; 212/190, 192, 230, 251

[56] References Cited

U.S. PATENT DOCUMENTS

| | | | |
|---|---|---|---|
| 3,078,680 | 2/1963 | Wepsala | 405/209 |
| 3,391,666 | 7/1968 | Schuller, Jr. | 114/265 X |
| 3,731,821 | 5/1973 | Wallis | 414/753 |
| 3,938,847 | 2/1976 | Peyton | 414/753 X |
| 4,285,629 | 8/1981 | Elliston | 212/192 X |

FOREIGN PATENT DOCUMENTS

| | | |
|---|---|---|
| 1462 | 4/1979 | European Pat. Off. . |
| 2425973 | 12/1979 | France . |
| 2474992 | 8/1981 | France . |

*Primary Examiner*—Sherman D. Basinger

*Attorney, Agent, or Firm*—Wigman & Cohen

[57] ABSTRACT

The invention relates to a U-shaped arrangement of floats which are ballastable and deballastable so as to raise and lower their height in the water. On each parallel leg of the float arrangement, are mounted supporting beams that are movable along their longitudinal axes so that they may extend into the center of the U-shaped arrangement of floats and also be retracted therefrom. The device may be used for lifting and transporting large loads by placing the load in the center of the U-shaped arrangement of floats while the floats are ballasted so that they sit low in the water, extending the supporting beams into the center of the arrangement of floats so that they are underneath the load, and then deballasting the floats so that they rise higher in the water while lifting the load. In the deballasted mode, the device may be transported to a desired location, where the load may then be deposited by ballasting the floats until the load is resting on its intended support, and then retracting the support beams out from underneath the load.

9 Claims, 22 Drawing Figures

FIG.: 1
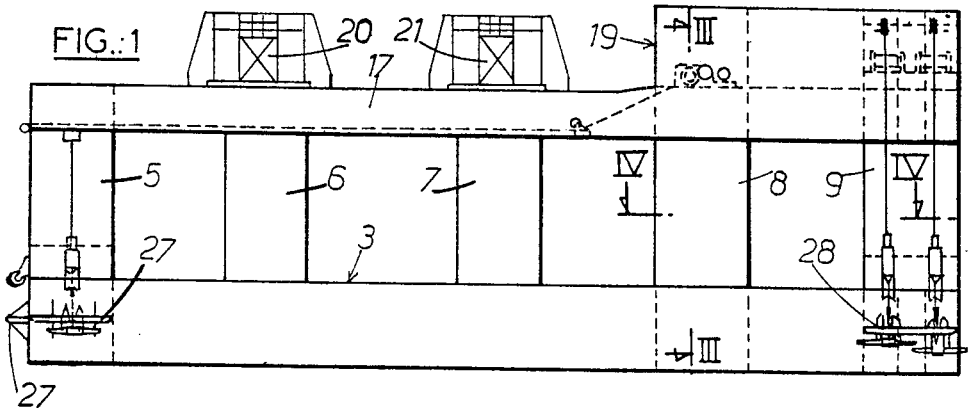
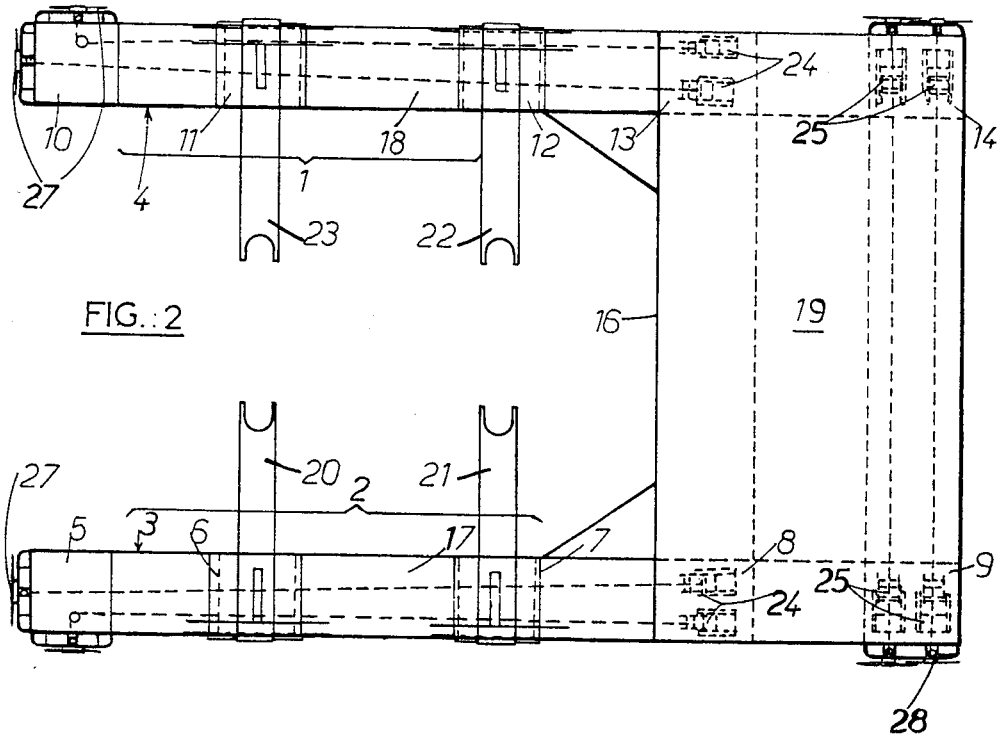
FIG.: 2

XII
XII
51
19
50
20
23
42
2
1

FLOATING DEVICE FOR HOISTING AND TRANSPORTING LOADS

BACKGROUND OF THE INVENTION

The invention relates to a load lifting and transport device with adjustable buoyancy for operations at sea, said device consisting of two parallel groups of floats connected at one of their ends, each group comprising a horizontal float to which vertical floats are fixed by one of their ends, one end of one group being connected to one end of the other group by a horizontal float and distance elements. The invention likewise deals with a method of using said device.

Operations at sea, and particularly the construction or the maintenance of oil drilling platforms, necessitate powerful transport and lifting means employing barges and barge cranes, the limited capacities of which present problems demanding complex and onerous solutions.

French Pat. No. 2,474,992 describes a device with adjustable buoyancy permitting the lifting to considerable heights of loads beyond the capacity of the available barge cranes. The device assumes the shape of a U consisting of two parallel groups of floats connected at one of their ends by a float with horizontal axis and by partly demountable distance elements. The horizontal and vertical floats are ballastable. The vertical floats of one group are connected at their emergent end by distance elements forming a longitudinal beam. The load is placed between the two longitudinal beams, whilst the pumps and the command station are arranged on the distance elements forming a transverse beam at the end of the groups of floats.

Such a device is used, inter alia, for positioning decks on the columns, during the construction or the dismantling of platforms. Generally, the deck is brought up to the site on barges, from which it is taken by the device with adjustable buoyancy which is brought up above the columns on each side of the latter. After ballasting, the deck comes to rest upon the columns.

The device described, and incidentally any other lifting means, being applied to the edges of the deck or of the structural element, subjects the latter to forces which necessitate a reinforcement of the structure in order to prevent deformations. Generally, the structure of a deck is designed to rest on four or more points located within the perimeter of the deck, which transmit all the forces to the columns. The distribution of the bending moments in the structure of the deck corresponds approximately to that of a beam supported at two non-extreme points. In the case of lifting a fully equipped deck by its edges, the distribution of the bending moments corresponds to that of a beam supported at its ends. The realisation of a structure capable of fulfilling both conditions involves a not inconsiderable increase in production costs, due to the increase in the weight of the deck itself.

OBJECTS AND SUMMARY OF THE INVENTION

The invention has as its aim a lifting device with variable buoyancy, comprising supporting means for the fully equipped deck which do not necessitate any reinforcement of its structure, and a method of using said device.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

The explanations and drawings given below by way of example will permit the manner in which the invention may be performed to be understood.

FIG. 1 shows a longitudinal view of the device according to the invention.

FIG. 2 is a view in plan of the same device.

DETAILED DESCRIPTION OF A PREFERRED EMBODIMENT

FIGS. 1 and 2 show, in a longitudinal view and in plan, the device with adjustable buoyancy according to the invention, consisting of two parallel groups 1 and 2 of floats. Each group comprises a horizontal float 3, 4, to which the vertical floats 5 to 14 are fixed by one of their ends.

Figure 3:
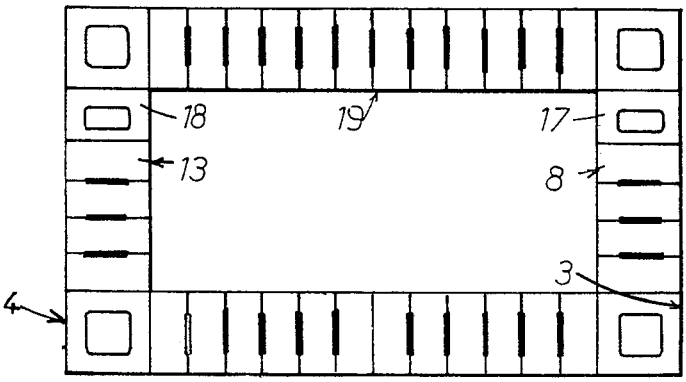
FIG. 3 is a view according to the section III—III of FIG. 1.
Figure 4:
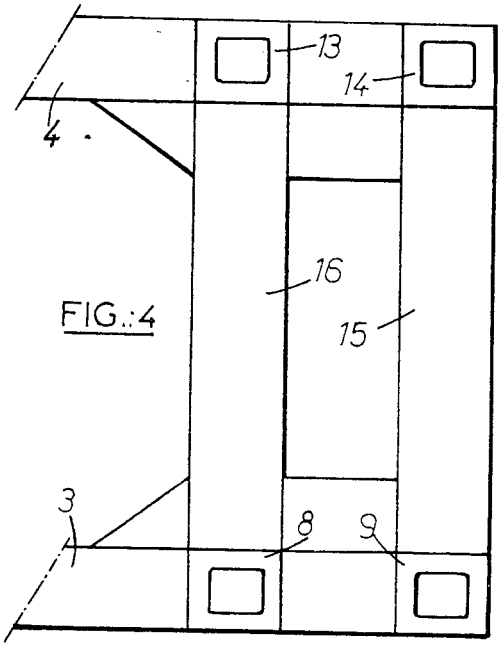
FIG. 4 is a view according to the section IV—IV of FIG. 1.

The two groups are connected at one of their ends by transverse horizontal floats 15, 16 (FIG. 4). According to the embodiment illustrated, the floats 15 and 16 are fixed in line with the end vertical floats 9 and 14 and with the penultimate floats 8, 13 arranged approximately at one quarter of the length of the groups with reference to one end.

The vertical floats are maintained at their upper part by longitudinal beams 17 and 18 and by a transverse caisson beam 19 covering all the space included between the vertical floats 13, 14, 18, 19. The caisson beam is fixed to the top face of the longitudinal beams 17, 18. At least a part of the horizontal and vertical floats are divided into compartments by fluid-tight bulkheads (not shown) and are equipped with ballasting and draining circuits (not shown) controlling the buoyancy and the attitude of the device.

In the exemplary embodiment illustrated, the vertical floats 7 and 12 arranged approximately at the median part of each group can optionally be placed in communication, on the one hand with the sea through means consisting of large-diameter cocks, and on the other hand with the atmosphere through air bleed valves.

When the communications are made, the movements of the lifting device due to the swell are greatly reduced.

The space included between the vertical floats 5, 6, 7, 10, 11, 12 is entirely free in the vertical and longitudinal directions, and that included between the floats 8, 9, 13, 14 is free longitudinally and limited in the vertical direction by the caisson beam 19 and the horizontal floats 15 and 16. According to the exemplary embodiment, the vertical clearance between the horizontal floats 15, 16 and the beam 19 is of the order of 15 meters, and the transverse clearance of the order of 30 meters.

Movable transverse supporting beams 20, 21, 22, 23 capable of moving along their longitudinal axis are arranged along the longitudinal beams 17, 18. The beams can likewise be moved along the longitudinal beams 17, 18 and locked, by known means, in positions determined as a function of the dimensional characteristics of the load.

The construction of the movable supporting beams will be described later.

The device with adjustable buoyancy according to the invention is equipped with eight anchors 27, 28 fitted to the ends of cables wound on winches 24, 25, on which they can be hauled or locked. The distribution of the anchors is as follows: four anchors 28 forward, two to port and two to starboard, and four anchors 27 aft, two to port and two to starboard. These anchors permit inter alia the transverse and longitudinal movements of the device. The winches 24 and 25 are arranged in the caisson beam 19 and the port anchors 28 are actuated by the starboard winches 25 and vice versa for the starboard anchors. This arrangement permits satisfactory winding of the cables onto the winches.

The caisson beam 19, the principal function of which is to effect a rigid and nondeformable connection between the two groups of floats, is developed on two storeys as living quarters and technical quarters.

According to a special feature of these quarters, the caisson beam is entirely fluid-tight, access and egress are provided solely on the upper part or roof of the beam. Known means, such as ladders and/or staircases, connect the roof to the longitudinal beams 17, 18.

Figures 5, 6:
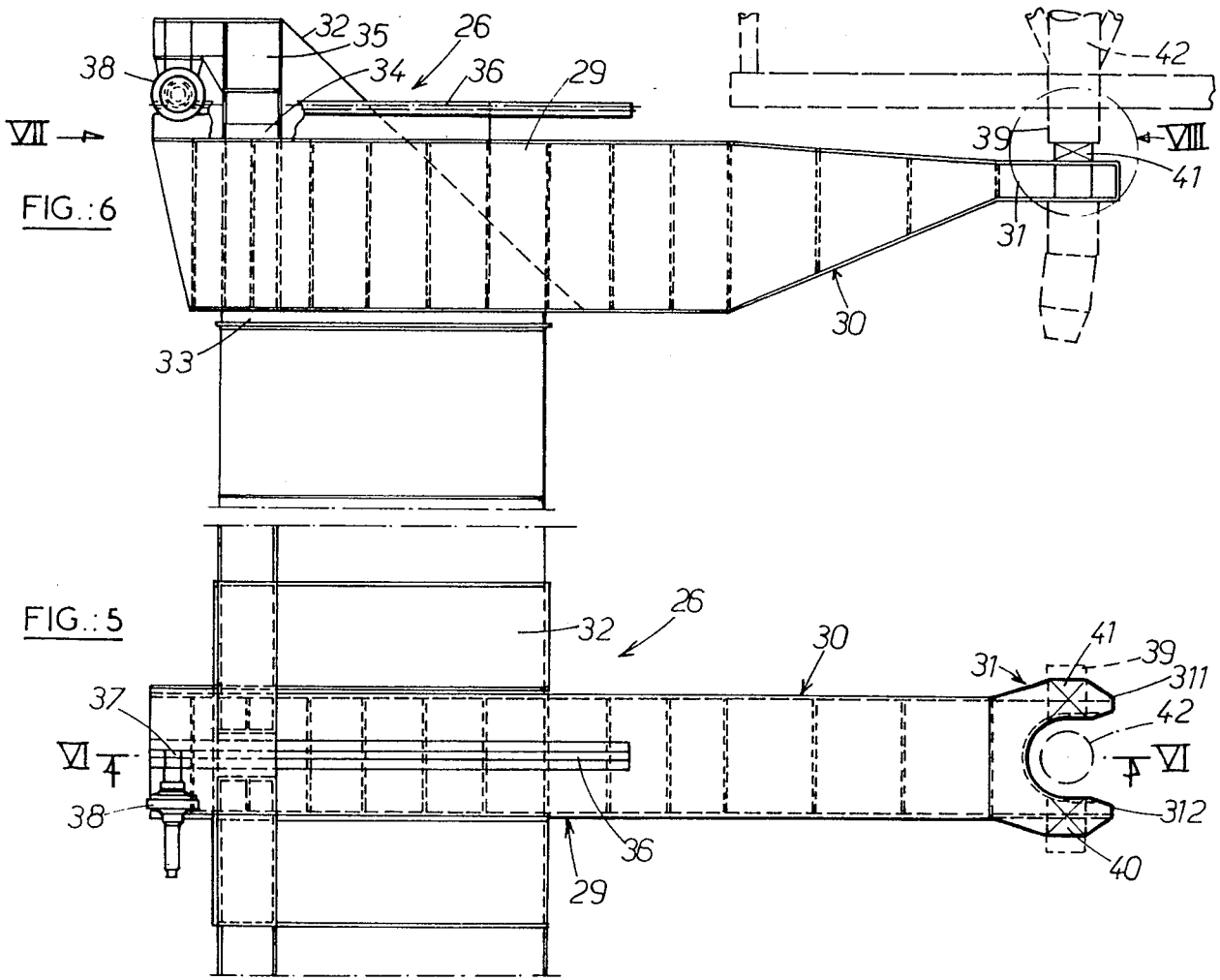
FIG. 5 is a view in plan and in partial section of a supporting beam.
FIG. 6 is a view in section according to VI—VI of FIG. 5.
Figure 7:
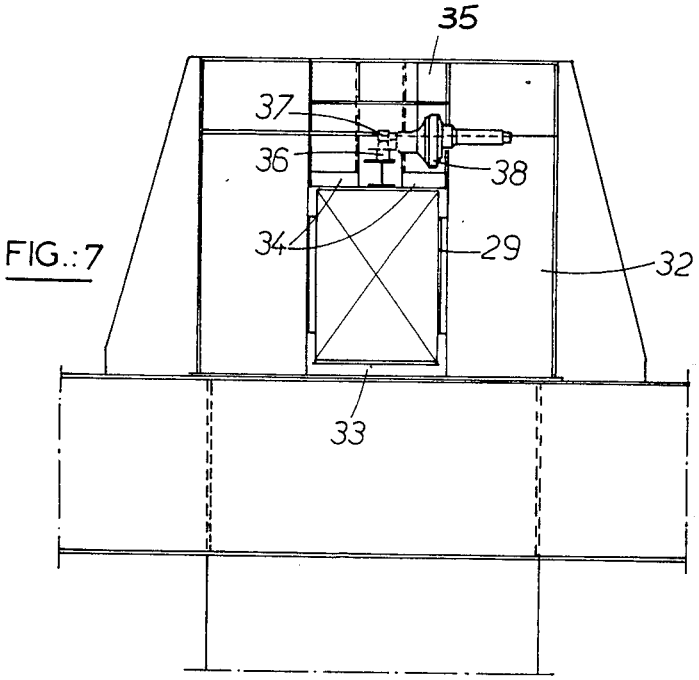
FIG. 7 is a view according to VII of FIG. 6.

The movable supporting beams 20, 21, 22, 23 shown in FIGS. 5, 6, 7 consist of an arm 26 formed by a parallelepipedic caisson structure 29 exhibiting a prismatic end 30 fitted with a fork 31. This arm slides longitudinally between the members of a stirrup 32 on a soleplate 33 consisting, for example, of a bronze anti-friction element. Bearing and friction feet 34 fixed to a cross-member 35 connecting the end of the members of the stirrup absorb the swinging forces of the arm. A rack 36, which is attached to the top part of the arm, cooperates with a pinion 37 fitted at the shaft end of a motor 38 fixed to the cross-member 35. The actuation of this motor permits the movement of the arm 26 and its positioning beneath the bracket means 39 attached to the load. The dogs 311, 312 of the fork 31 carry elastic rests 40, 41, formed in known manner by alternate layers of elastomer and of metal foils vulcanised together. The purpose of these rests will be specified later.

The rests 40, 41 come into contact with the brackets 39 (FIG. 6) attached to the load.

Figure 8:
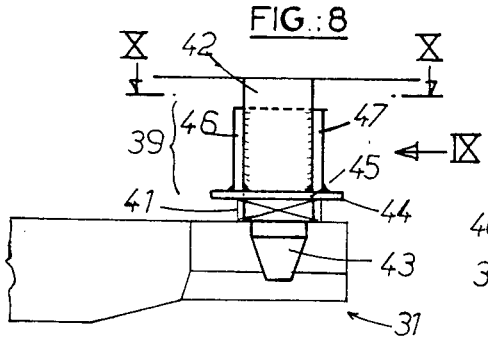
FIG. 8 is a view on a larger scale of the detail VIII of FIG. 6.
Figure 9:
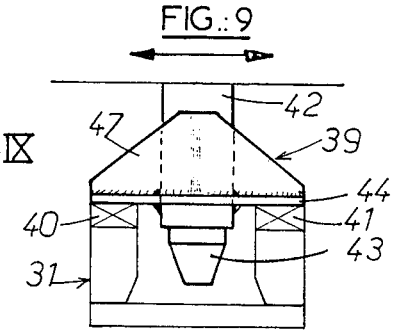
FIG. 9 is a view according to IX of FIG. 8.
Figure 10:
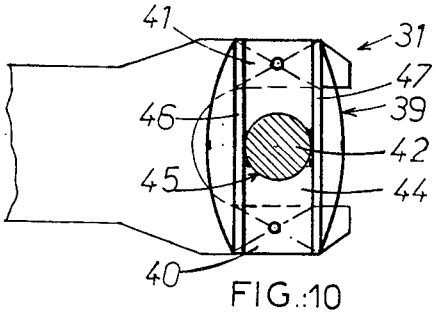
FIG. 10 is a view in section according to X—X of FIG. 8.

FIGS. 8, 9, 10 show on a larger scale different views of the detail VIII of FIG. 6. The deck of the platform, a part of the elements of which is shown by dash lines, consists of main beams bearing upon supporting legs 42. The main beams carry legs intended to serve as support for the structure of the deck when it rests upon the columns of the marine structure or "jacket". To facilitate the positioning of the legs upon the columns, a cylindro-conical centering piece 43 is fixed to the end of the legs and is adapted to be engaged in the tubes which form the columns.

In order to permit the lifting of the deck by its legs, a U-shaped bracket 39 has been provided, the transverse member 44 of which carries a central bore 45 adapted to receive the tube 42. The lateral members 46, 47 of the U, considered in plan, are triangular and form with reference to the transverse member 44 reinforcing gussets which absorb the forces exerted at the ends of said member. The bracket 39 is welded at right angles to the tube 42 along its central bore and, by its lateral members, along a generatrix of the tube. The member 44 forms two cross-members of sufficient length to rest on the rests 40, 41 of the fork 31. The elastic rests 40, 41 act as dampers and prevent violent shocks which might occur during the lifting and/or the positioning of the deck, giving it a certain degree of freedom in the transverse sense (shown by the arrow FIG. 9).

The lifting and transport device according to an exemplary embodiment of the invention has an overall length of 61 meters, an overall width of 41 meters and a height of 19 meters at the longitudinal beams and 24 meters at the caisson beam. It is capable of transporting and lifting a load of the order of 2,000 tons. The living quarters are provided for 80 men.

The method of using the lifting and transport device according to the invention is described with reference to a load which, according to one example, is represented by a platform deck fully equipped, either with installations for living quarters, or with technical installations for drilling or operation.

FIGS. 11 to 22 show the different stages of a lifting and a poositioning of a deck upon the columns of the marine structure.

Figures 11, 12, 13, 14, 15, 16, 17:
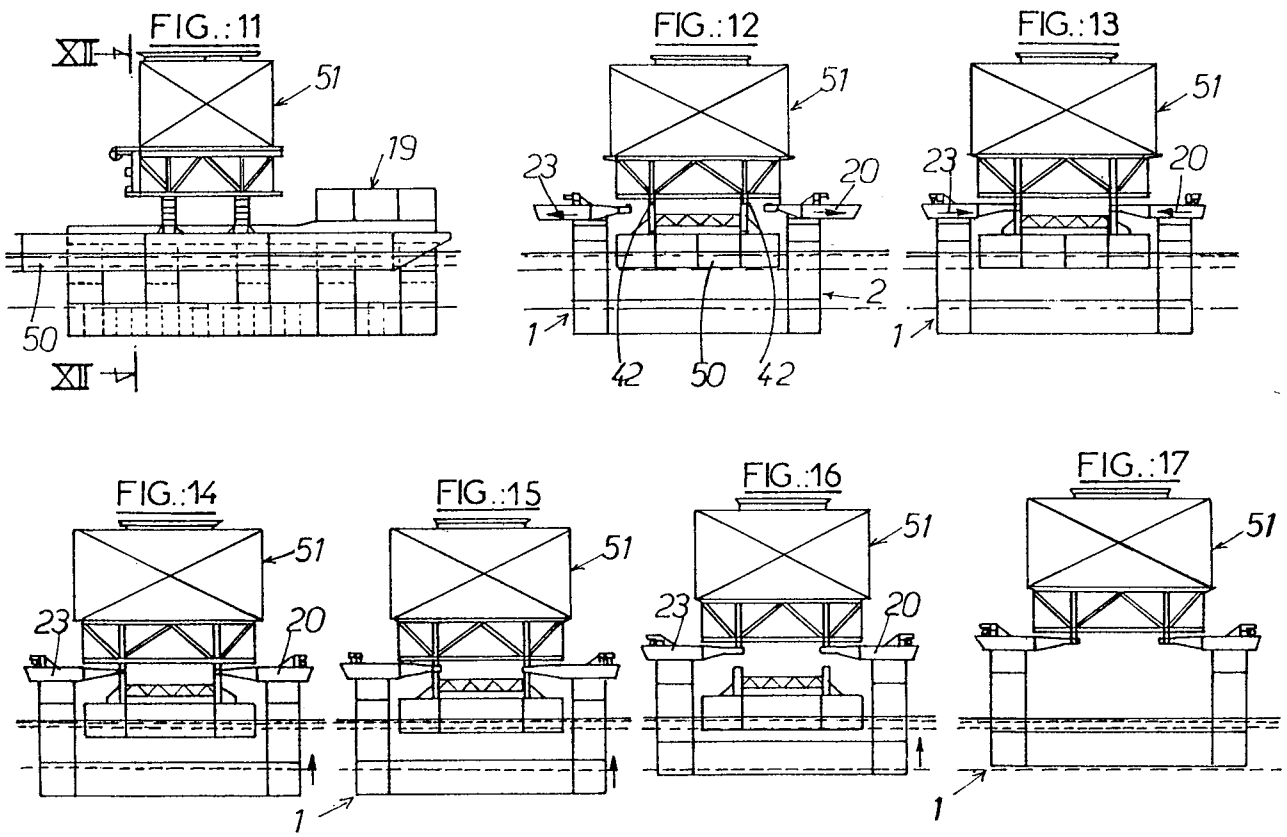
FIG. 11 illustrates a partly fragmented side elevation of the first stage of the method of using the device according to the invention.
FIGS. 12 to 22 show different stages of the method according to the invention, viewed in the section XII—XII of FIG. 11.
Figure 20:
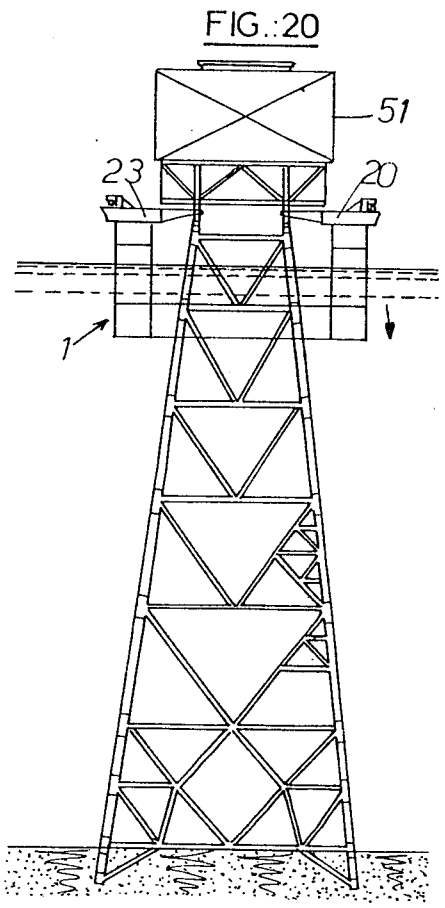
Figure 19:
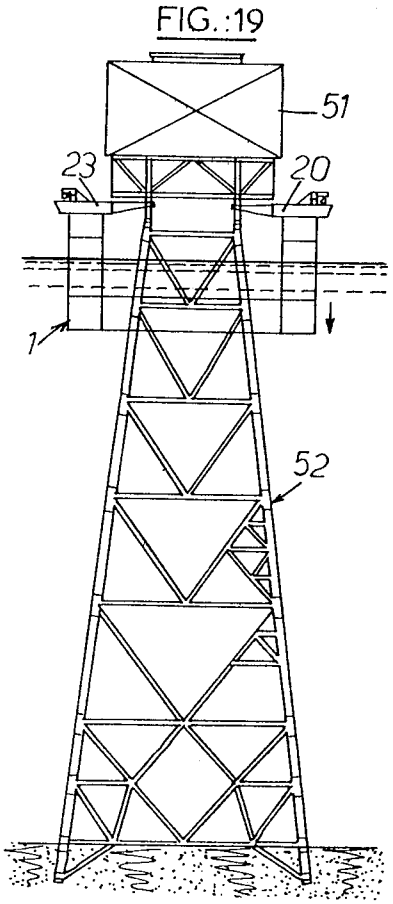
Figure 18:
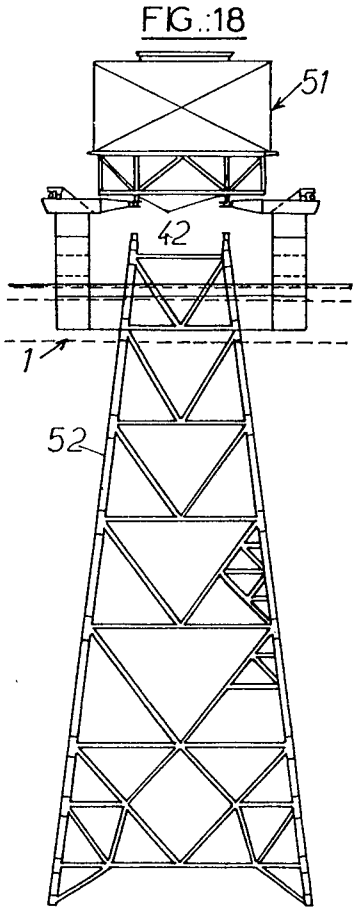
Figure 22:
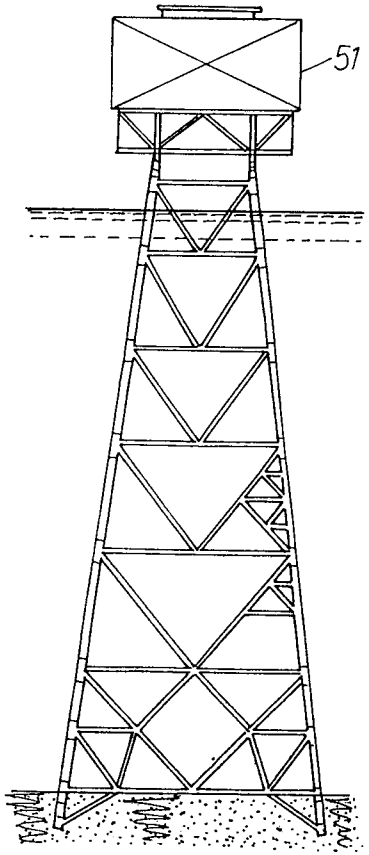
Figure 21:
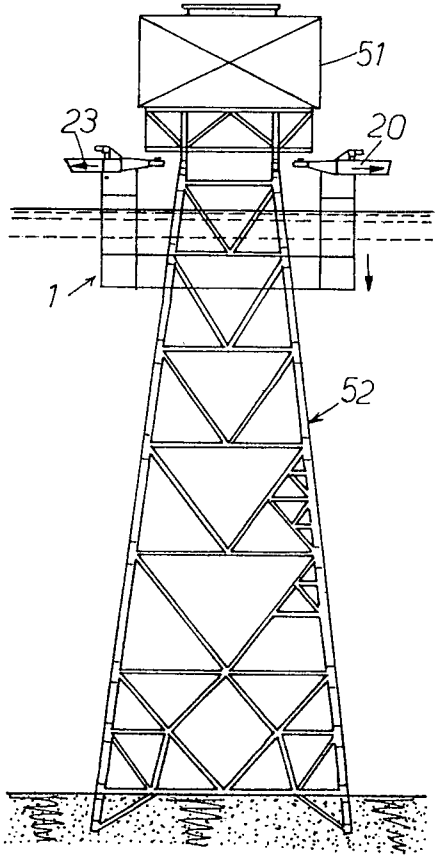

FIGS. 11 and 12 show, viewed in elevation and in section, the arrival of the barge 50 supporting the deck 51. The barge enters through the rear of the lifting and transport device between the groups of floats 1, 2, the supporting beams 20, 21, 22, 23 being retracted outwards in the direction of the arrow. The ballasting of the barge is such as to permit the latter to pass freely beneath the caisson beam 19. The deck is maintained on the barge, in known manner, the ends of the legs of the deck cooperating with the support columns forming part of a lattice structure fixed on the deck of the barge. The ends of the support columns of the barge are identical in shape and in relative position to those of the columns of the marine structure or "jacket". The height of the columns is provided so that, under the above-defined conditions of buoyancy, the structure of the deck is at a higher level than that of the supporting beams 20, 21, 22, 23. The supporting beams (FIG. 13) are extended inwards in the direction of the arrows, so as to bring the forks 31 beneath the brackets 39 attached to the legs of the deck. Both the above operations are performed without modifying the ballasting of the barge and of the lifting device. The device is deballasted in order to increase its buoyancy and to bring the forks 31 and the brackets 39 into contact (FIG. 14). The deballasting is continued so that the load rests entirely upon the supporting beams through the intermediary of the forks 31 and of the brackets 39 (FIG. 15). The deballasting is continued in order to disengage the barge 50 entirely (FIG. 16) and to move it clear either forwards or backwards of the device. The device carrying the load is towed to the site (FIG. 17) and, after deballasting if required, is placed above the works required to support the load, that is to say above the columns of the marine structure 52 (FIG. 18). The load is positioned exactly flush with the columns by the manoeuvres of the device on its anchors. The device is ballasted until the legs of the deck are brought into contact with the columns of the structure (FIG. 19), and this is continued (FIG. 20) until the weight of the load is transferred to the columns. The supporting beams are retracted outwards in the direction of the arrows (FIG. 21) and the device is disengaged from the platform.

During the operations preparatory to the transfer of the load from the transport barge to the device or from the device to the marine structure, the vertical floats (7, 12) in the centre of the device are preferably placed in communication with the sea in order to reduce the effects of the swell, the residual movement being absorbed by the elastic rests on the forks of the supporting beams.

The device according to the invention therefore makes possible, in a simple manner and without immobilising substantial means, the placing or removal of the deck, equipped or not, on marine structures with columns of the "jacket" type or others, and consequently the modification of the purpose of a platform, provided that these supports have the same relative positions and shapes.

Although only preferred embodiments are specifically illustrated and described herein, it will be appreciated that many modifications and variations of the present invention are possible in light of the above teachings and within the purview of the appended claims without departing from the spirit and intended scope of the invention.

We claim:

1. A load lifting and transport device with adjustable buoyancy for operations at sea, for lifting and transporting a fully equipped deck having legs for supporting the deck on a marine platform, said device comprising:

two parallel groups of floats, each group having a horizontal float and vertical floats fixed by one of their ends to the horizontal float, the other ends of the vertical floats being fixed to longitudinal beams, one end of one group being connected to one end of the other group by a transverse horizontal float and a distance element;

a plurality of supporting beams transversely mounted on the longitudinal beams, said supporting beams movable along the longitudinal beams and having an end movable toward and away from the longitudinal axis of the transport device for cooperating with the load to lift it; and means mounted on the legs of the deck for engaging with the ends of the movable supporting beams.

2. The device according to claim 1, wherein the end of each movable supporting beam facing the inside of the device carries a two prong fork adapted to cooperate with brackets attached to the load.

3. The device according to claim 2, wherein the prongs of the forks carry at their upper part elastic rests for cooperating with the load.

4. The device according to claim 1, wherein each of the transverse supporting beams comprise:

an arm formed by a parallelepipedic caisson structure having a prismatic end fitted with a fork;

a stirrup, between members of which, the arm slides longitudinally;

a sole-plate and bearing and friction shoes fixed respectively to a lower transverse part of the members of the stirrup permitting the movement and the maintenance of the arm;

a rack fixed longitudinally on the arm; and a motor carrying at the end of its shaft a pinion cooperating with the rack to actuate the longitudinal movements of the arm.

5. The device according to claim 1, wherein the vertical float placed approximately at the median part of each group comprises means to place it in free communication with the sea and the atmosphere.

6. A device for lifting and transporting a load having support legs, comprising:

two parallel groups of floats, said floats being ballastable and deballastable so as to lower or raise their height;

means for connecting one end of one group to one end of the other group so that the groups and connecting means form a U-shape; and supporting beams mounted on the groups of floats, said beams being movable along their longitudinal axes so that they may extend into the center of the device and be retracted therefrom;

brackets mounted on said legs of the load for engaging with the beams;

whereby the load may be lifted by placing it in the center of the device, extending the beams under the load, engaging the beams with the load brackets and deballasting the floats.

7. The load lifting and transport device according to claim 6, wherein said supporting beams include a fork at one end for engaging the load to be lifted.

8. A method of lifting and transporting a load having support legs by a device having two parallel groups of floats each of which support retractable supporting beams, comprising:

(a) ballasting the device;

(b) bringing the load, the weight of which is supported by a barge, up behind the device between the groups of floats, the supporting beams being retracted outwardly;

(c) extending the supporting beams inwardly beneath the legs of the load;

(d) deballasting the device to increase its buoyancy and bringing the supporting beams into contact with the legs of the load;

(e) continuing the deballasting until the entire load is supported by the legs upon the supporting beams;

(f) further continuing the deballasting to lift the load totally from the barge;

(g) moving the barge clear of the device;

(h) towing the device to a load transfer site and positioning the device above a structure intended to support the load;

(i) ballasting the device until the legs of the load are in contact with the structure;

(j) retracting the support beams outward; and (k) disengaging the device from the structure and load.

9. The method according to claim 8, wherein during operations (d), (e), (f), and (i), vertical floats placed approximately at the median part of each group are placed in free communication with the sea and the atmosphere.

* * * * *